United States Patent [19]

Rizzo et al.

[11] 3,989,123

[45] Nov. 2, 1976

[54] VANDAL PROOF INTERLOCK SWITCH

[75] Inventors: Dominick Rizzo, Deer Park, N.Y.; Richard J. Conway, Norwood, N.J.

[73] Assignee: Atlantic Elevator Corporation, Belleville, N.J.

[22] Filed: Jan. 17, 1975

[21] Appl. No.: 541,889

[52] U.S. Cl. ..... 187/48; 200/61.7; 200/61.82

[51] Int. Cl.[2] ..... B66B 1/00

[58] Field of Search ..... 187/48, 31, 61, 57, 187/50, 52; 200/61.65, 61.71, 61.72, 61.73, 61.74, 61.75, 61.62, 61.82, 61.7

[56] References Cited

UNITED STATES PATENTS

| | | | |
|---|---|---|---|
| 583,696 | 6/1897 | Strohm | 187/48 |
| 1,144,479 | 6/1915 | Keyes | 187/48 |
| 1,346,111 | 7/1920 | Boedtcher | 187/31 X |
| 1,349,313 | 8/1920 | Barrett | 187/48 |
| 1,479,164 | 1/1924 | Way | 187/48 |
| 1,484,277 | 2/1924 | Schakel et al. | 187/31 |
| 2,989,148 | 6/1961 | Moser | 187/48 |
| 3,157,756 | 11/1964 | Close et al. | 200/61.7 |
| 3,625,312 | 12/1971 | Hutner | 187/48 |
| 3,689,718 | 9/1972 | Gorsuch | 200/61.62 |
| 3,840,715 | 10/1974 | Gwozdz | 200/61.7 |

FOREIGN PATENTS OR APPLICATIONS

| | | | |
|---|---|---|---|
| 49,846 | 4/1889 | Germany | 200/61.7 |
| 867,129 | 5/1961 | United Kingdom | 200/61.7 |

*Primary Examiner*—Johnny D. Cherry
*Assistant Examiner*—James L. Rowland

[57] ABSTRACT

A conventional elevator system includes an elevator shaft, an elevator cab and means for moving the elevator cab along the shaft. The elevator cab has a sliding cab door to provide access thereto and electrically operated means for moving the cab door. A door buck opening into the shaft is provided with a shaft door movable relative to the buck to expose the cab door when the cab is aligned therewith. An interlock mechanism is provided connected between the shaft door and buck which, when actuated by the closing of the shaft door, completes an electrical circuit thereby permitting actuation of the means for moving the cab door to close same and, in turn, the means for moving the cab along the shaft. The present invention relates to a secondary interlock means located within the shaft wall above the door buck and operably connected to prevent completion of the electrical circuit of the primary interlock means by external means to bypass the primary interlock mechanism when the shaft door is opened. This eliminates the possibility of unauthorized entry into the elevator shaft and the possibility of receiving an electrical shock from the primary interlock means.

12 Claims, 2 Drawing Figures

VANDAL PROOF INTERLOCK SWITCH

Figure 1:
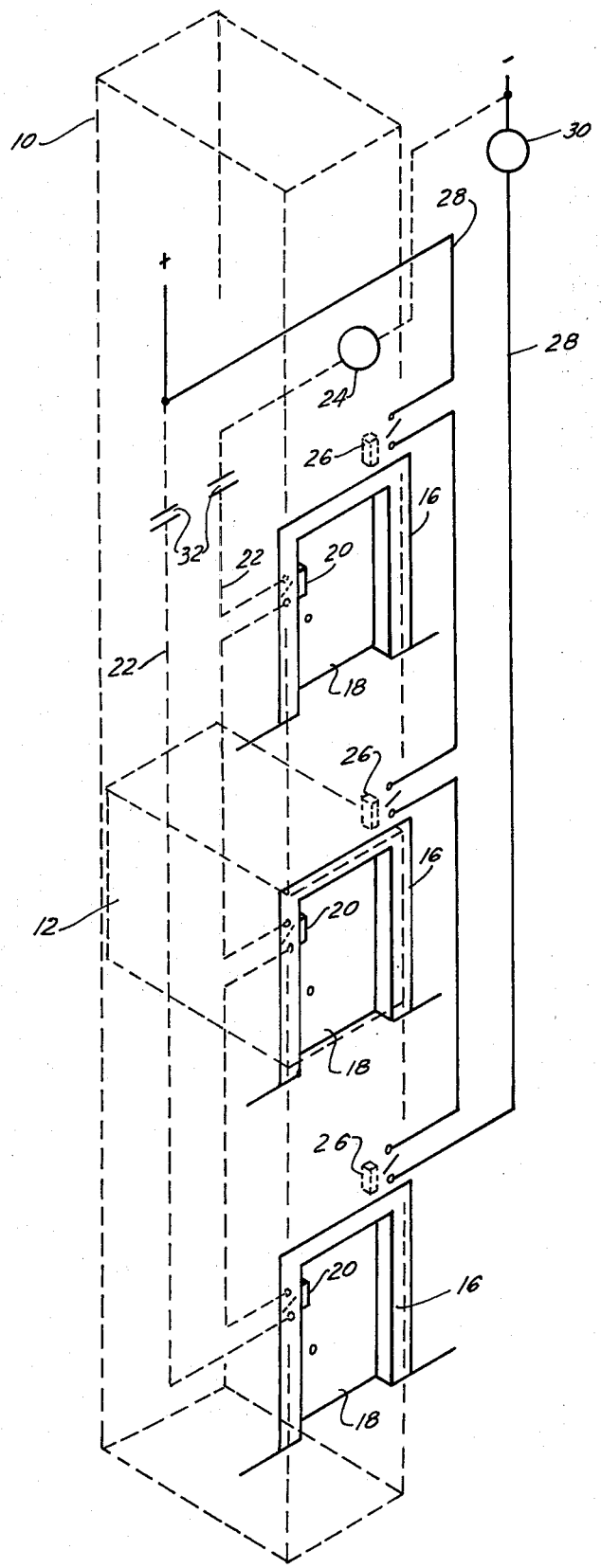

The present invention relates to elevator systems and, more particularly, to a vandal-proof interlock mechanism for use in conjunction with the primary interlock means to prevent tampering therewith.

A conventional elevator system comprises an elevator shaft, an elevator cab and means for moving the elevator cab along the shaft. The elevator cab is provided with a sliding cab door and electrically operated means for moving the cab door. A door buck opening into the shaft is provided in the hallway adjacent the shaft on each floor at which the cab stops. For each buck, a shaft door is provided movable relative to the buck to expose the cab door when the cab is aligned therewith. A primary interlock mechanism operatively connected between the shaft door and buck is provided which, when actuated by closing the shaft door, permits the actuation of the means for moving the cab door and thus the means for moving the cab along the shaft.

Another function of the interlock means is to eliminate accidents by preventing the opening of the shaft door until such time as the elevator cab is aligned therewith and the cab door is opened. In this manner, access to the elevator shaft is prevented because only the shaft door aligned with the elevator cab may be opened, all other shaft doors being held closed by their respective interlocks. In addition, the interlock senses the shaft door opened condition and stops the cab door from closing when the shaft door is opened thus preventing closing of the cab door on a passenger while he is entering or leaving the cab.

The conventional interlock is a well-known mechanical and electrical apparatus. When the cab door is closed or the cab is not aligned with the shaft door, the mechanical portion of the interlock prevents the shaft door from being opened from the hallway. When the shaft door is opened, the electrical portion of the interlock causes an electrical circuit to open preventing the electrically operated means for closing the cab door, and the means for moving the cab along the shaft, from being activated until the shaft door is closed.

The primary interlock is normally positioned on the exterior of the door buck and thus is exposed to the public. Since in the conventional system there is always electrical current flowing within the interlock, a passenger placing a portion of his body or other object into the interior of the interlock will receive an electrical shock. Further, because the interlock is exposed, it is possible to bypass the primary interlock in order to cause the cab door to close and the cab to move along the shaft while the shaft door remains opened. This has caused severe problems because of criminal activities which have taken place in elevators.

In particular, elevators in high-rise public housing have represented a common area hazardous to personal safety. Information compiled by housing authorities indicates that much of the criminal activity which takes place in such public housing is centered around the elevators. The elevator has become a convenient and, when between floors, a private and concealed place for the criminal activity to take place.

Youths in such public housing developments have learned how to bypass the existing primary interlock on the shaft door by placing an electrically conductive object within the exposed interlock to complete the electric circuit to open the shaft door and thus gain access to the shaft. Once in the shaft, the criminal can perch on top of the elevator cab and then stop the elevator between floors by operating the inspector's control station located above the cab. After stopping the elevator between floors, the criminal can open the hatch on top of the cab and burglarize or rape the unsuspecting passengers in the elevators.

It should be recognized that while criminal activites centering around elevators most often occur in low cost public housing, the problem is compounded because funds for installing equipment in such housing to prevent this problem are usually limited. Therefore, any solution to such problems must, to be viable, be of low cost. As a practical matter, this means that it must be usable with the relatively expensive equipment already in use and must be relatively inexpensive to manufacture, easy to install and be as maintainence free as possible.

It is, therefore, a prime object of the present invention to provide a vandal-proof interlock mechanism for use in conjunction with the primary interlock of a conventional elevator system which can be utilized in conjunction with the pre-existing installation with only minor modifications thereof.

It is another object of the present invention to provide a vandal proof interlock mechanism for use in conjunction with the primary interlock mechanism of a conventional elevator system which eliminates electrical power from the primary interlock when the shaft door is opened thereby preventing the possibility of electric shock therefrom and also the possibility of bypassing the primary interlock to obtain entrance into the elevator shaft.

It is a further object of the present invention to provide a vandal proof interlock mechanism for use in conjunction with the primary interlock mechanism of a conventional elevator system wherein the mechanism is situated within the shaft wall above the door buck and thus while completely inaccessible to the public, can be repaired and maintained relatively easily and inexpensively by the appropriate maintenance personnel.

It is still another object of the present invention to provide a vandal proof interlock mechanism for use with the primary interlock mechanism of a conventional elevator system wherein the interlock is located in a cast steel, water-tight and oil-proof gasketed enclosure such that it is protected from the environment thereby reducing maintenance thereon.

In accordance with the present invention, a vandal proof interlock mechanism is provided for use in conjunction with the primary interlock mechanism of a conventional elevator system, the elevator system being of the type consisting of an elevator shaft, an elevator cab and means for moving the elevator cab along the shaft. The cab normally includes a sliding cab door and electrically operated means for moving the cab door. A door buck is provided opening into the shaft having a shaft door movable relative to the buck to expose the cab door when the elevator cab is aligned therewith. A primary interlock mechanism of the well-known electrical and mechanical type is provided physically placed between the shaft door and the buck and operatively connected to an electrical circuit the closing of which permits actuation of the means for moving the cab door to close same and in turn the means for moving the cab along the shaft.

The vandal proof interlock mechanism of the present invention is responsive to the movement of the shaft door from the closed position thereof to prevent the bypassing of the primary interlock mechanism by preventing the completion of the electrical circuit forming a part thereof. The secondary interlock mechanism is located and concealed within the shaft wall immediately above the shaft door buck within a cast steel, water-tight, oil-proof gasketed enclosure. The shaft door is, in one type of mechanism, pivotally connected to the door buck by means of a hinge which is modified to have an outwardly extending hinge pin. The hinge pin extends into the interior of the shaft wall above the buck and into the enclosure. The pin is provided with a cam thereon which is rotated as the shaft door is pivoted. The rotation of the cam actuates a microswitch which prevents actuation of the primary interlock by cutting off the electrical power to the primary interlock thus preventing the completion of the electrical circuit. This eliminates the possibility of bypassing the primary interlocks as well as the possibility of receiving an electric shock from the interlock.

Figure 2:
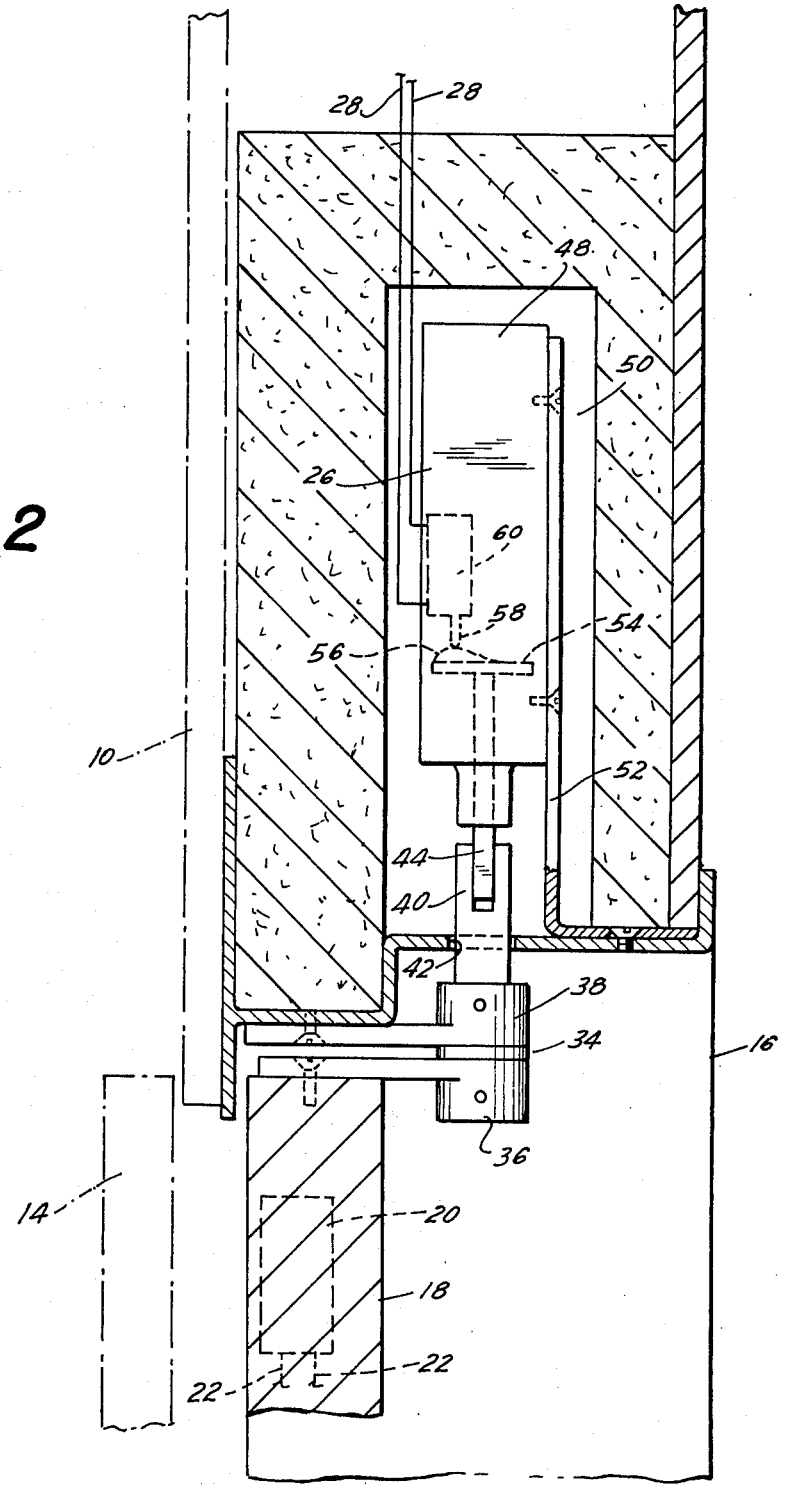

To the accomplishment of the above and such other objects as may hereinafter appear, the present invention relates to a vandal proof interlock mechanism as defined in the appended claims and as described in the specification taken together with the drawings wherein like numerals refer to like parts and in which:

FIG. 1 is a schematic representation of a portion of a conventional elevator system wherein the vandal proof interlock mechanisms of the present invention have been installed in conjunction with the primary interlock mechanisms; and FIG. 2 is a side cross-sectional view of the vandal proof interlock mechanism of the present invention showing the location thereof within the shaft wall above the door buck.

As shown in the drawings, a conventional elevator system includes an elevator shaft 10 and an elevator cab 12, movable along the shaft by means of cables (not shown) connected to a lift mechanism (not shown) and controlled by a conventional master control mechanism, only the pertinent part of which is shown. The elevator cab has a sliding cab door 14, as shown in FIG. 2, and is provided with electrically operated means for moving the cab door (not shown) which are controlled by the master elevator control. Shaft 10 is provided with a number of access openings, one of which is situated on each floor where the elevator stops. While FIG. 1 shows only three such openings, it is to be understood that as many of such openings may be provided as are required. Each of these openings is provided with a door buck 16 which opens into the shaft and a shaft door 18 movable relative to the buck 16 to expose the cab door when the elevator cab is aligned with the opening. Door 18 is illustrated herein as being of the pivoting type. However, it should be understood that shaft doors of the sliding type could also be utilized in conjunction with the present invention when the necessary and obvious mechanical modifications are made thereto.

The elevator system is provided with a primary interlock system, of the conventional type, which consists, in part, of a series of standard combination mechanical lock and electrical sensing devices 20, one of which is physically connected between each door 18 and buck 16. The primary interlock system connections for the electrical portion of the interlocks are shown in dashed lines in FIG. 1. The connections for the mechanical portion of the system are not shown. The mechanical portion of the primary interlock 20 prevents the opening of door 18 unless the elevator cab is properly aligned therewith. Once the elevator cab is properly aligned with the shaft door 18, the elevator door 14 will open and permit the opening of door 18 through the release of the mechanical portion of the primary interlock 20. Once the passenger has passed through the cab door and is located within the cab, the cab door closes. The closing of the cab door will not take place until the electrical sensing portion of interlock 20 senses that shaft door 18 is also closed. When both doors are closed, the elevator may be moved to a different position along the shaft. However, the elevator will not move unless both doors are closed.

The sensor portion of each of the interlocks 20 is electrically connected to the master elevator control by means of connectors 22 which run down shaft 10. The primary interlocks 20 along the shaft are arranged in series sequence along connectors 22. If any of the shaft doors 18 are opened, the sensor portion of the interlock 20 associated therewith causes the master control to prevent the cab door from closing and the elevator cab will not move.

FIG. 1 shows schematically the electrical portion of interlocks 20 which are utilized to sense the position of the respective shaft doors 18. The mechanical portion of these interlocks and the electrical connections therefor which are utilized to prevent the opening of the shaft doors when the cab door is not aligned with the buck and the cab door is not opened, are not shown as they are conventional to all interlock systems such as the one shown herein and form no part of the present invention. The sensing portion of interlocks 20 are connected to the master elevator control by means of connectors 22 which in the conventional system are always energized. When the shaft door 18 is closed, the circuit which includes a power source, connectors 22 and interlocks 20 is completed. The completion of this electrical circuit energizes a "door closed" relay 24 to close the contacts associated therewith to permit the closing of the cab door and the activation of the cab moving means. Since the interlocks 20 are always electrically energized, it is possible to bypass a primary interlock when the shaft door associated therewith is opened by inserting an electrically conductive object into the exposed interlock to complete the electric circuit thus causing relay 24 to close. In addition, since the interlocks are always energized, it is possible to receive an electrical shock therefrom when the shaft door to which the interlock is connected is opened.

Only the pertinent portion of the elevator master control is shown. The "door closed relay" 24 is in series with interlocks 20 on connectors 22. When all the shaft doors are closed, each of the primary interlocks 20 is actuated, the electric circuit is closed and relay 24 is energized. The contacts of relay 24 are located in that portion of the control mechanism (not shown) which controls the movement of the cab door and the movement of the cab along the shaft. Thus, when the primary interlock mechanisms 20 are all actuated by closing the shaft doors associated therewith (or bypassed), relay 24 conditions the control mechanism to permit the cab door to close and the movement of the cab along shaft 10.

The present invention relates to a series of secondary interlock mechanisms 26 which are located within the shaft wall immediately above each of the door bucks 16. Interlocks 26 are connected in series along a separate pair of connectors 28 which extend along the length of the shaft. In series with connectors 28 is a relay 30, the contacts 32 of which are placed in a series with each of the conductors 22 of the primary interlock system. Thus, the secondary interlocks are operatively connected between the shaft doors and the primary interlock system. Contacts 32 are normally opened but are held in the closed position when relay 30 is energized. Thus, when all of the doors 18 are closed, interlocks 26 complete the circuit of connectors 28 thereby energizing relay 30 to close contacts 32. However, when one of the doors 18 are opened, relay 30 is deenergized thereby opening contacts 32 and thus disconnecting connectors 22 from the source of electrical power. In this manner, primary interlocks 20 are deactuated thereby preventing electrical shock therefrom and also preventing the bypassing thereof. Thus, if a particular door 18 is opened (although the primary interlock mechanism 20 connected thereto may be bypassed) the interlock mechanism 26 associated therewith is deactuated and therefore relay 24 cannot be energized and thus the cab door will not close and the elevator will not move along the shaft.

As seen in FIG. 2, shaft door 18 is connected to door buck 16 by means of a 180° top pivot hinge such as those manufactured by Rixson Closers, Franklin Park, New York. Hinge 34 has a bottom portion 36 connected to the door buck 16. The pivot stud 40 is modified to extend above portion 38 through an opening 42 in the top of the door buck and to mate with a pin 44 in a tongue and groove relationship. Pin 44 extends within enclosure 48 in which the interlock mechanism is situated. Enclosure 48 is preferably a cast steel, water-tight and oil-proof gasketed enclosure which is situated within the shaft wall immediately above the buck. During installation, an opening 50 is created in the shaft wall immediately above the buck and an aperture 42 is formed in the top of the buck to permit pin 40 to extend therein. Enclosure 48 is removably affixed to a bracket 52 which in turn is secured to buck 16.

Pin 44 has a disc-shaped cam 54 connected thereto for rotation therewith. On the upper surface of cam 54 is provided an arcuate protrusion 56 having a relatively steep vertical incline. A cam follower 58 is urged into contact with protrusion 56 by a spring (not shown). The microswitch 60 is operably connected to cam follower 58 such that when the door is in the closed position switch 60 is closed thereby completing the circuit through connectors 28. The relay 30 connected in series with connectors 28 has single pole, double throw, double break circuit contacts. This circuit will give consistent make and break points because the circuit parts are not subject to oscillating motions. Microswitch 60 preferably has a contact reading of 10 amperes at 600 volts AC or DC. The rotary cam 54 is preferably adjustable to a 35° pre-travel maximum with an 8° maximum differential therein.

Thus, the secondary interlock of the present invention is, in part, a top rotary cam operated microswitch designed for direct connection into the master elevator control circuit. During operation, rotation of the pin 44 46 (caused by opening or closing of the elevator shaft door) causes the cam 54 to rotate and operate switch 60 for circuit operation. The top rotary cam switch is assembled to operate with both clockwise and counterclockwise movement of the cam for quick make and break operation.

A "tongue and groove" connection is utilized between pivot stud 40 and pin 44 to permit easy removal of the hinge 34, if required. Enclosure 48 is located with an opening 50 in the elevator shaft immediately above the door buck to prevent access by unauthorized personnel to the interlock. This prevents unauthorized personnel from entering the shaft at any point because interlocks 26 cannot be bypassed.

Thus, the present invention is an interlock system which can be used in conjunction with the primary elevator mechanism of a conventional elevator system. Since the preexisting installation can be used in its entirety, the installation of the interlock system of the present invention is relatively inexpensive and thus well suited for use on a commercial scale in housing projects and the like. This system prevents unauthorized access to the elevator shaft as well as the possibility of electrical shock from the existing primary interlock mechanism.

While only a single preferred embodiment of the present invention has been described herein for purposes of illustration, it is apparent that many variations and modifications may be made to the particular structure disclosed. For instance, on elevator systems wherein the shaft door is of the sliding as opposed to the pivoting type, the interlock system of the present invention can be utilized by making the necessary modifications thereto such that the microswitch is tripped by the sliding (instead of pivoting) of the shaft door. It is intended to cover all of these variations and modifications which fall within the scope of the present invention as defined by the following claims:

We claim:

1. In an elevator system comprising an elevator shaft, an elevator cab, means for moving the elevator along the shaft, a cab door, means for moving the cab door between an opened and a closed position, a door buck opening into the shaft, a shaft door movable relative to the buck and primary interlock means operatively connected between the shaft door and the cab door moving means and effective, when actuated, to permit actuation of the cab door moving means to close the cab door, the improvement comprising secondary interlock means operatively connected between the shaft door and the primary interlock means and effective, when deactuated to prevent actuation of the primary interlock means and means operatively connecting said secondary interlock means to said shaft door, said connecting means being effective to deactuate said secondary interlock means when said shaft door is opened.

2. The system of claim 1 wherein the primary interlock means is actuated by completing an electrical circuit and wherein the deactuation of the secondary interlock means is effective to prevent the completion of said electrical circuit.

3. The system of claim 1 wherein said secondary interlock means is concealed within the elevator shaft immediately above the door buck.

4. The system of claim 1 wherein the shaft door is pivotally connected to the door buck by means of a hinge, including a hinge pin and wherein said connecting means comprises a portion of said hinge pin extending outwardly beyond said hinge.

5. The system of claim 4 wherein said extended hinge pin extends into the interior of the elevator shaft wall above the door buck.

6. The system of claim 5 wherein said secondary interlock means comprises a cam operated microswitch operatively connected to the primary interlock means and effective, when deactuated, to prevent actuation of the primary interlock means.

7. The system of claim 6 wherein said cam is operably connected to said extended pin to be rotated thereby.

8. The system of claim 1 wherein said secondary interlock mechanism comprises a cam operated microswitch operatively connected to the primary interlock means and effective, when deactuated, to prevent actuation of the primary interlock means.

9. The system of claim 1 wherein actuation of said secondary interlock means prevents movement of the elevator along the shaft.

10. The system of claim 1 further comprising a second buck and shaft door located along the shaft at a position remote from the first buck and shaft door and means effective, when deactuated, to prevent the opening of said second door, wherein deactuation of said second interlock means activates said second shaft door opening preventing means.

11. The system of claim 1 wherein said secondary interlock is located within a water-tight and oil-tight enclosure.

12. In an elevator system comprising an elevator shaft, an elevator cab, means for moving the elevator along the shaft, a cab door, means for moving the cab door between an opened and a closed position, a door buck opening into the shaft, a shaft door movable relative to the buck and primary interlock means operatively connected between the shaft door and the cab door moving means and effective, when actuated, to permit actuation of the cab door moving means to close the cab door, the improvement comprising a second interlock means operatively connected between the shaft door and the primary interlock means and effective, when deactuated, to prevent the actuation of the primary interlock means, said shaft door being pivotally connected to the door buck by means of a hinge having an outwardly extending hinge pin, said hinge pin extending into the interior of the elevator shaft wall above the door buck, said secondary interlock means comprising a cam operated microswitch operatively connected to the primary interlock means and effective, when deactuated, to prevent actuation of the primary interlock means, said cam being operably connected to said extended pin to be rotated thereby.

* * * * *